US008059047B2

(12) United States Patent
Desclos et al.

(10) Patent No.: US 8,059,047 B2
(45) Date of Patent: Nov. 15, 2011

(54) CAPACITIVELY LOADED DIPOLE ANTENNA OPTIMIZED FOR SIZE

(75) Inventors: Laurent Desclos, San Diego, CA (US); Mark Krier, Fountain Valley, CA (US); Shane Thornwall, Moreno Valley, CA (US); Vaneet Pathak, San Diego, CA (US); Gregory Poilasne, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 1895 days.

(21) Appl. No.: 10/375,423

(22) Filed: Feb. 27, 2003

(65) Prior Publication Data

US 2004/0169614 A1 Sep. 2, 2004

(51) Int. Cl.
*H01Q 7/00* (2006.01)
*H01Q 9/32* (2006.01)

(52) U.S. Cl. ..... 343/749; 343/741; 343/846

(58) Field of Classification Search ..... 343/702, 343/795, 741–749, 700 MS, 793, 802, 803, 343/806, 828, 846
See application file for complete search history.

(56) References Cited

U.S. PATENT DOCUMENTS

| | | | | |
|---|---|---|---|---|
| 3,725,940 | A * | 4/1973 | Siple | 343/713 |
| 6,281,854 | B1 | 8/2001 | Ohoka et al. | |
| 6,424,300 | B1 | 7/2002 | Sanford et al. | |
| 6,549,169 | B1 | 4/2003 | Matsuyoshi et al. | |
| 6,597,318 | B1 | 7/2003 | Parsche et al. | |
| 6,674,409 | B2 * | 1/2004 | Cheah | 343/795 |
| 7,038,635 | B2 | 5/2006 | Fukushima et al. | |
| 2004/0135726 | A1 * | 7/2004 | Shamir et al. | 343/700 MS |
| 2004/0169614 | A1 | 9/2004 | Desclos et al. | |

FOREIGN PATENT DOCUMENTS

GB 2387486 A 10/2003

* cited by examiner

*Primary Examiner* — Michael C Wimer
(74) *Attorney, Agent, or Firm* — Coastal Patent, LLC

(57) ABSTRACT

A capacitively loaded magnetic dipole antenna is provided with a portion that comprises a length that is longer than a straight line distance between a first end and a second end of the third portion such that antenna with a tower profile and/or smaller form factor is achieved.

17 Claims, 5 Drawing Sheets

*Side-View*

CAPACITIVELY LOADED DIPOLE ANTENNA OPTIMIZED FOR SIZE

CROSS-REFERENCE TO RELATED APPLICATIONS

1. Field of the Invention

The present invention relates generally to antennas used for wireless communications, and particularly to size reduction and performance improvement of capacitively loaded magnetic dipole antennas used in wireless communications devices.

2. Background

Many present day applications require that antennas that provide large bandwidth, efficiency, and isolation in as small form factor as possible. The present invention addresses these requirements with a small low-profile/low-form factor antenna that provides increased bandwidth, and improved efficiency and isolation than previously available.

SUMMARY OF THE INVENTION

The present invention includes a wireless device comprising: a first portion; a second portion, the first and second portion disposed to effectuate a capacitive area; and a third portion, the third portion coupled to the first portion and to the second portion to effectuate an inductive area, wherein the third portion comprises a length having a first end and a second end, wherein the length is longer than a straight line distance between the first end and the second end, and wherein the first portion, the second portion, and the third portion define a capacitively coupled dipole antenna.

The present invention includes a dipole antenna comprising: a first portion; a second portion, the first and second portion disposed to create a capacitive area; and a third portion, the third portion comprising one or more portion, the third portion coupled to the first portion and to the second portion to create an inductive area, wherein the third portion comprises a length having a first end and a second end, and wherein the length is longer than a straight line distance between the first end and the second end. One or more portion of the third portion may be disposed relative to the first portion and the second portion in a non-parallel relationship. One or more portion of the third portion may be disposed relative to the first portion and the second portion in a parallel relationship. The first and second portion may be disposed in a generally coplanar relationship, and one or more portion of the third portion may be disposed in a plane that is in an angular relationship relative to the coplanar relationship of the first and second portion. The first portion, the second portion, and the third portion may be disposed on or above a ground plane. The antenna may include a substrate, wherein the first portion and the second portion are coupled to the substrate, and wherein the ground plane is disposed in an angular relationship relative to the substrate. The antenna may include a high dissipation factor substrate, wherein the first and second portion are coupled to the high dissipation factor substrate. The antenna may include a FR4 substrate. The FR4 substrate may be defined by a periphery, wherein within the periphery the FR4 substrate defines a void, and wherein the capacitive area generally spans the void. The first portion, the second portion, and the third portion may be coupled to create a capacitively coupled dipole antenna.

The present invention includes a system, comprising: a dipole antenna including, a first portion; a second portion, the first and second portion disposed in a relationship to create a capacitive area; and a third portion, the third portion coupled to the first portion and to the second portion and disposed to create an inductive area, wherein the third portion comprises a length having a first end and a second end, and wherein the length is longer than a straight line distance between the first end and the second end. The antenna may further include a high dissipation factor substrate. The antenna may include a FR4 substrate. The first and second portion may be coupled to the FR4 substrate, wherein the FR4 substrate is defined by a periphery, wherein within the periphery the FR4 substrate defines a void, and wherein the capacitive area generally spans the void. The system may comprise a wireless communications device.

The present invention includes a capacitively coupled dipole antenna, comprising: capacitance means for creating a capacitance; and inductive means for creating an inductance. The antenna may comprise a first portion, a second portion, and a third portion, wherein the third portion comprises a length having a first end and a second end, and wherein the length is longer than a straight line distance between the first end and the second end. The antenna may comprise a substrate. The first and second portion may be coupled to the substrate, wherein the substrate is defined by a periphery, wherein within the periphery the substrate defines a void, wherein the capacitance generally spans the void.

The present invention includes a method for creating a resonance in a resonant circuit comprising the steps of: providing a first portion; providing a second portion; disposing the first and second portion to create a capacitive area; and providing a third portion, wherein the third portion comprises a length having a first end and a second end, and wherein the length is longer than a straight line distance between the first end and the second end; and coupling the third portion to the first portion and to the second portion to create an inductive area. The method may further include the step of: providing a high dissipation factor substrate, wherein the high dissipation factor substrate is defined by a periphery, wherein within the periphery the high dissipation factor substrate defines a void, and wherein the capacitive area generally spans the void.

Other embodiments and other features will become apparent by referring to the Description and the claims that follow.

DETAILED DESCRIPTION OF THE INVENTION

In the following description, for purposes of explanation and not limitation, specific details are set forth in order to provide a thorough understanding of the present invention. However, it will be apparent to those skilled in the art that the present invention may be practiced in other embodiments that depart from these specific details. In other instances, detailed descriptions of well-known methods and devices are omitted so as to not obscure the description of the present invention with unnecessary detail.

Figure 1A:
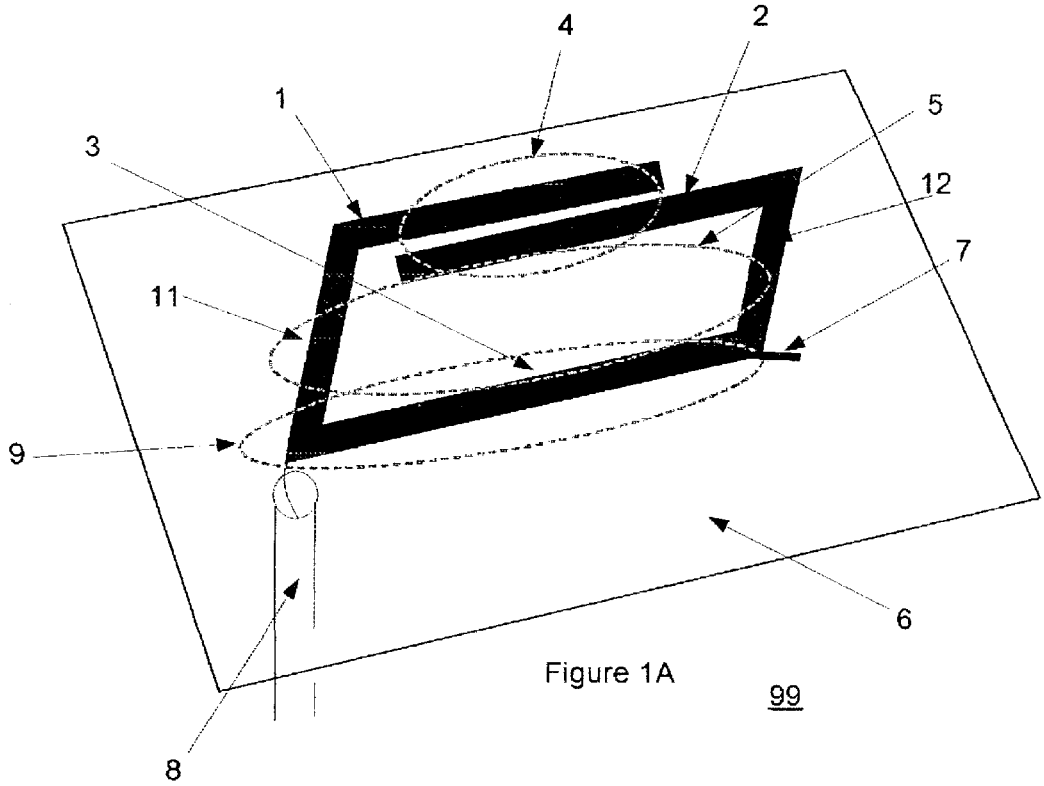
FIGS. 1*a-b* illustrate a respective three-dimensional and side-view of a capacitively loaded dipole antenna.
Figure 1B:
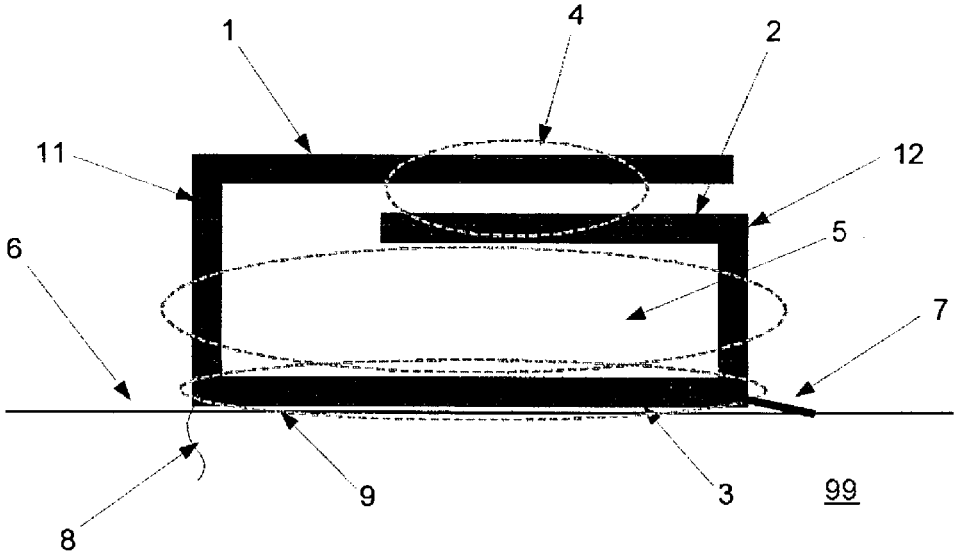

FIGS. 1*a-b* illustrate respective three-dimensional and side views of one embodiment of a capacitively loaded magnetic dipole antenna (99). In one embodiment, antenna (99) comprises a first (1), a second (2), and a third (3) portion. In one embodiment, the first portion (1) is coupled to the third portion (3) by a first coupling portion (11), and the third portion (3) is coupled to second portion (2) by a second coupling portion (12). In one embodiment, antenna (99) comprises a feed area, generally indicated as feed area (9), where input or output signals are provided by a feedline (8) that is coupled to the third portion (3). In one embodiment, the first coupling portion (11) and the second coupling portion (12) are disposed relative to each other in a generally parallel relationship. In one embodiment, first portion (1), second portion (2), and third portion (3) are disposed relative to each other in a generally parallel relationship. In one embodiment, first portion (1), second portion (2), and third portion (3) are disposed relative to each other in a generally coplanar relationship. In one embodiment, the portions (1), (2), and (3) are generally orthogonal to portions (11) and (12). In one embodiment, one or more of portions (1), (2), (3), (11), (12) are disposed in a generally orthogonal or parallel relationship relative to a grounding plane (6). It is understood, however, that the present invention is not limited to the described embodiments, as in other embodiments portions (1), (2), (3), (11), (12) may be disposed relative to each other and/or grounding plane (6) in other geometrical relationships and with other geometries. For example, first portion (1) may be coupled to third portion (3), and third portion (3) may be coupled to second portion (2) by respective coupling portions (11) and (12) such that one or more of the portions are disposed relative to each other in non-parallel, non-orthogonal, and/or non-coplanar relationships. In one embodiment, portions (1), (2), (3), (11), and (12) may comprise conductors. The conductors may be shaped to comprise one or more geometry, for example, cylindrical, planar, etc., or other geometries known to those skilled in the art. The conductors may be flexible, rigid, or a combination thereof.

In one embodiment, third portion (3) is disposed coplanarly with, or above, grounding plane (6). In one embodiment, third portion (3) is electrically isolated from grounding plane (6), other than where third portion (3) is coupled to grounding plane (6) at a grounding point (7).

It is identified that third portion (3) may include one or more portion that is shaped to comprise other geometries, for example, a linear geometry, a curved geometry, a combination thereof, etc.

It is also identified that antenna (99) may be modeled as a radiative resonant LC circuit with a capacitance (C) that corresponds to a fringing capacitance that exists across a first void that is bounded generally by first portion (1) and second portion (2), and which is indicated generally as capacitive area (4); and with an inductance (L) that corresponds to an inductance that exists in a second void that is bounded generally by the second portion (2) and third portion (3), and which is indicated generally as inductive area (5).

It is further identified that the geometrical relationship between portions (1), (2), (3), (11), (12), and the gaps formed thereby, may be used to effectuate an operating frequency about which the antenna (99) resonates to radiate or receive a signal.

Figure 1C:
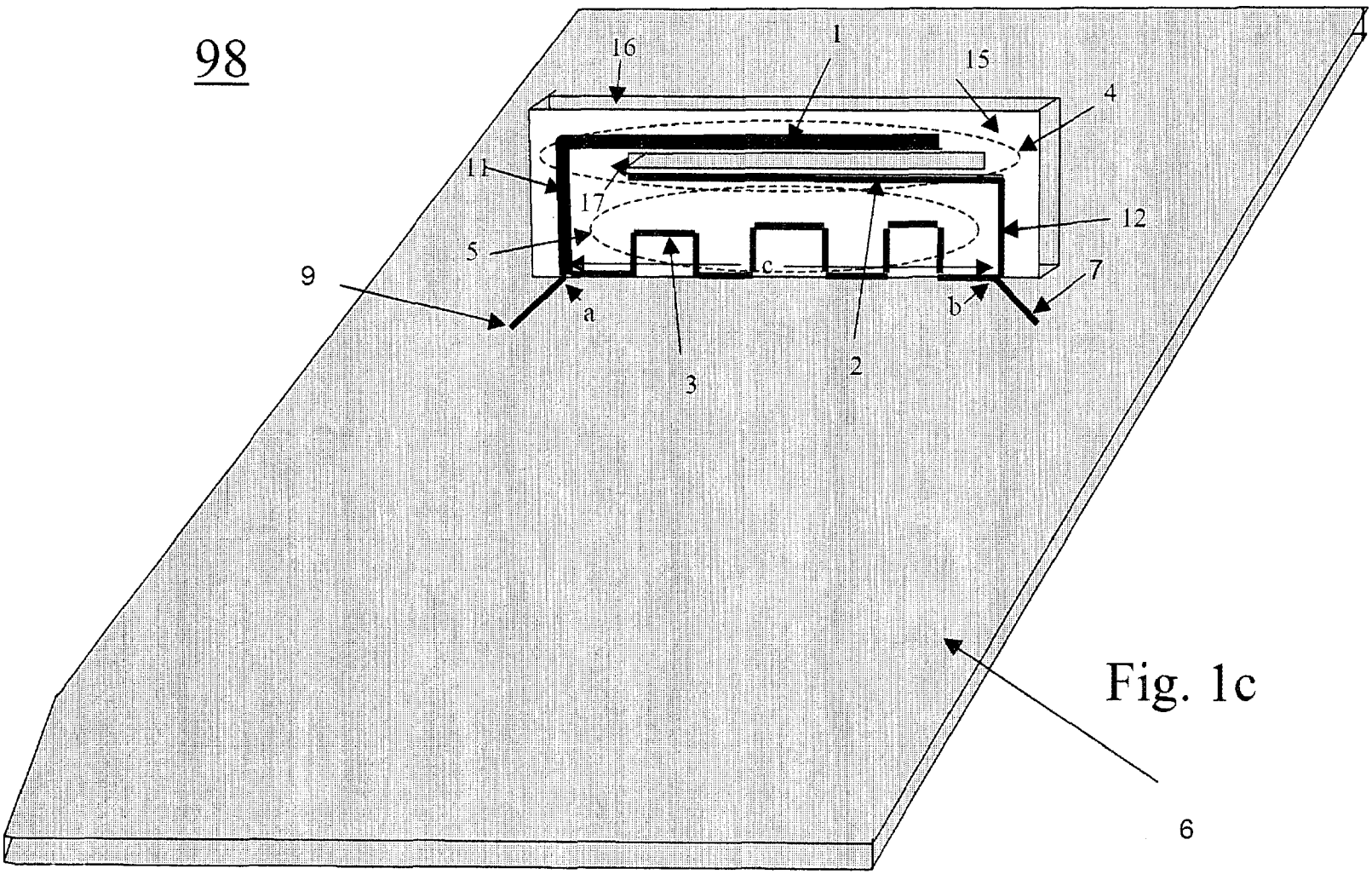
FIG. 1*c* illustrates a three dimensional view of a low profile/small form factor capacitively loaded dipole antenna.

FIG. 1*c* illustrates a three-dimensional view of an embodiment of a capacitively loaded magnetic dipole antenna (98). Some aspects of antenna of (98) are similar to embodiments of antenna (99) described previously above and may be understood by those skilled in the art by referring to the description of antenna (99). However, it is identified that at least one aspect of antenna (98) differs from that of antenna (99). For example, in one embodiment, third portion (3) is defined by a length that is longer than a straight-line distance (c) between a first end (a) and a second end (b) of the third portion. In the illustrated embodiment, third portion (3) includes linear portions that are coupled in alternating orthogonal orientations. In one embodiment, the linear portions are disposed in generally parallel and/or orthogonal relationships relative to a grounding plane (6). It is identified that third portion (3) may include one or more portion that comprises or is coupled to comprise other geometries, for example, a linear geometry, a curved geometry, a combination thereof, etc.

In one embodiment, portion (1), portion (2), and portion (3) are coupled to a substrate (15). In one embodiment substrate (15) comprises a high dissipation factor substrate, for example, a FR4 substrate known by those skilled in the art. In one embodiment, substrate (15) is defined by an outer periphery (16) and by an inner periphery (17), and the inner periphery defines a void within the substrate. In one embodiment, the capacitive area (4) generally spans the void.

It is identified that by coupling the first portion (1) and second portion (2) to a high dissipation factor substrate (15) such that the capacitive area (4) spans the void (17), the capacitance of antenna (98) may be increased over that of the capacitance of antenna (99). As compared to a capacitance of the antenna (99), an antenna (98) that has an equivalent capacitance may be provided to comprise a smaller form-factor/profile, for example, as measured in a direction orthogonal to grounding plane (6).

It is also identified that by providing a third portion (3) that comprises a length that is longer than a straight tine distance (c) between the first end (a) and the second end (b) of the third portion, the antenna (98) inductance in the inductive area (5) may be increased over that of the inductance of the antenna (99). As compared to an inductance of antenna (99), an antenna (98) that has an equivalent inductance may be provided to comprise a smaller form-factor/profile, for example, as measured in a direction orthogonal to grounding plane (6).

Figure 2A:
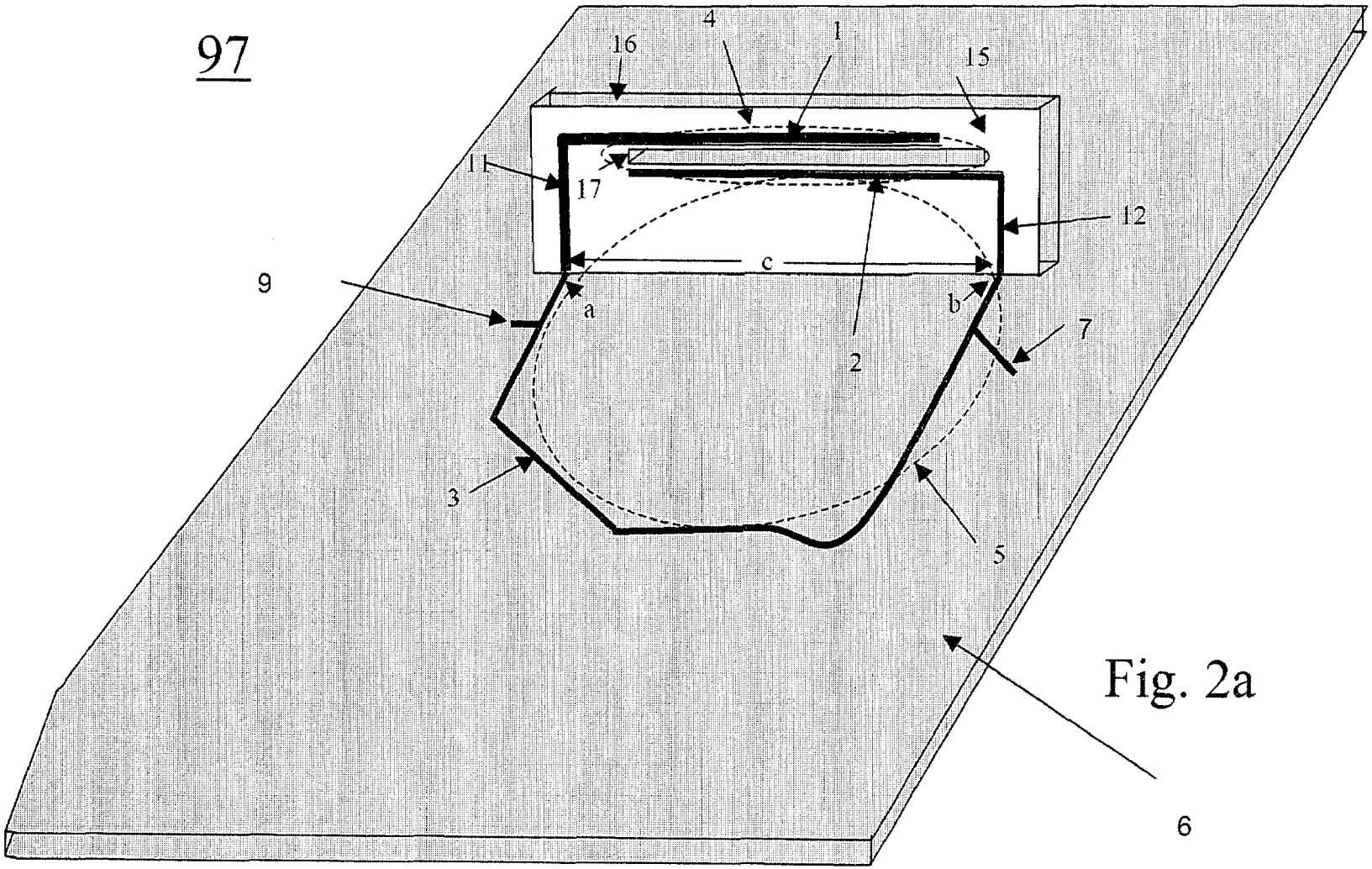
FIG. 2*a* illustrates a three dimensional view of a low profile/small form factor capacitively loaded dipole antenna.

FIG. 2*a* illustrates a three-dimensional view of a capacitively loaded magnetic dipole antenna (97). In one embodiment, antenna (97) comprises a first (1), a second (2), and a third (3) portion. It is identified that antenna (97) may be modeled as a radiative resonant LC circuit with a capacitance (C) that corresponds to a fringing capacitance that exists in a capacitive area (4) that is bounded generally by first portion (1) and second portion (2); and with an inductance (L) that corresponds to an inductance that exists in an inductive area (5) that is bounded generally by the second portion (2) and the third portion (3). In one embodiment, the first portion (1) is coupled to the third portion (3) by a first coupling portion (11), and the third portion (3) is coupled to second portion (2) by a second coupling portion (12). In one embodiment, antenna (98) comprises a feedline (8) coupled to the third portion (3) where input or output signals are provided.

Some aspects of antenna of (97) are similar to embodiments of antenna (99) described previously above and may be understood by those skilled in the art by referring to the description of antenna (99). However, it is identified that at least one aspect of antenna (97) differs from that of antenna (99). For example, in one embodiment, third portion (3) is defined by a length that is longer than a straight-line distance (c) between a first end (a) and a second end (b) of the third portion. FIG. 2*a* also illustrates an embodiment of antenna (98) wherein third portion (3) is disposed in a generally non-coplanar relationship relative to the generally coplanar relationship of the first portion (1) and second portion (2). In one embodiment, third portion (3) may be disposed in a plane that is generally coplanar with, or above, a grounding plane (6). In one embodiment, third portion (3) may be electrically isolated from the grounding plane (6) other than where third portion (3) is coupled to grounding plane (6) at a grounding point (7). It is identified that third portion (3) may include one or more portion that comprises or is coupled to comprise other geometries, for example, a linear geometry, a curved geometry, a combination thereof, etc.

In one embodiment, the grounding plane (6) and/or one or more portion of third portion (3) may be disposed in a plane that is generally orthogonal to a coplanar relationship of the first portion 91) and the second portion (2). In one embodiment (not illustrated), the grounding plane (6) and/or one or more portion of third portion (3) may be disposed in a plane that is in a generally angular relationship relative to a substrate (15), which first portion (1) and second portion (2) are coupled to. In one embodiment, the angular relationship of third portion relative to substrate (15) may be between 0 and 180 degrees. In one embodiment, substrate (15) comprises a high dissipation factor substrate, for example, a FR4 substrate. In one embodiment, substrate (15) is defined by an outer periphery (16) and by an inner periphery (17), and the inner periphery defines a void within the substrate. In one embodiment, the capacitive area (4) spans the void.

It is identified that by coupling the first portion (1) and second portion (2) to a high dissipation factor substrate (15) such that the capacitive area (4) spans the void, the capacitance of antenna (97) may be increased over that of the capacitance of antenna (99). As compared to a capacitance of antenna (99), an antenna (97) that has an equivalent capacitance may be provided to comprise a smaller form-factor/profile.

It is also identified that by providing a third portion (3) that comprises a length that is longer than a straight tine distance (c) between the first end (a) and the second end (b) of the third portion, the antenna (97) inductance in the inductive area (5) may be increased over that of the inductance of antenna (99). As compared to an inductance of antenna (99), an antenna (97) that has an equivalent inductance may be provided to comprise a smaller form-factor/profile.

Figure 3A:
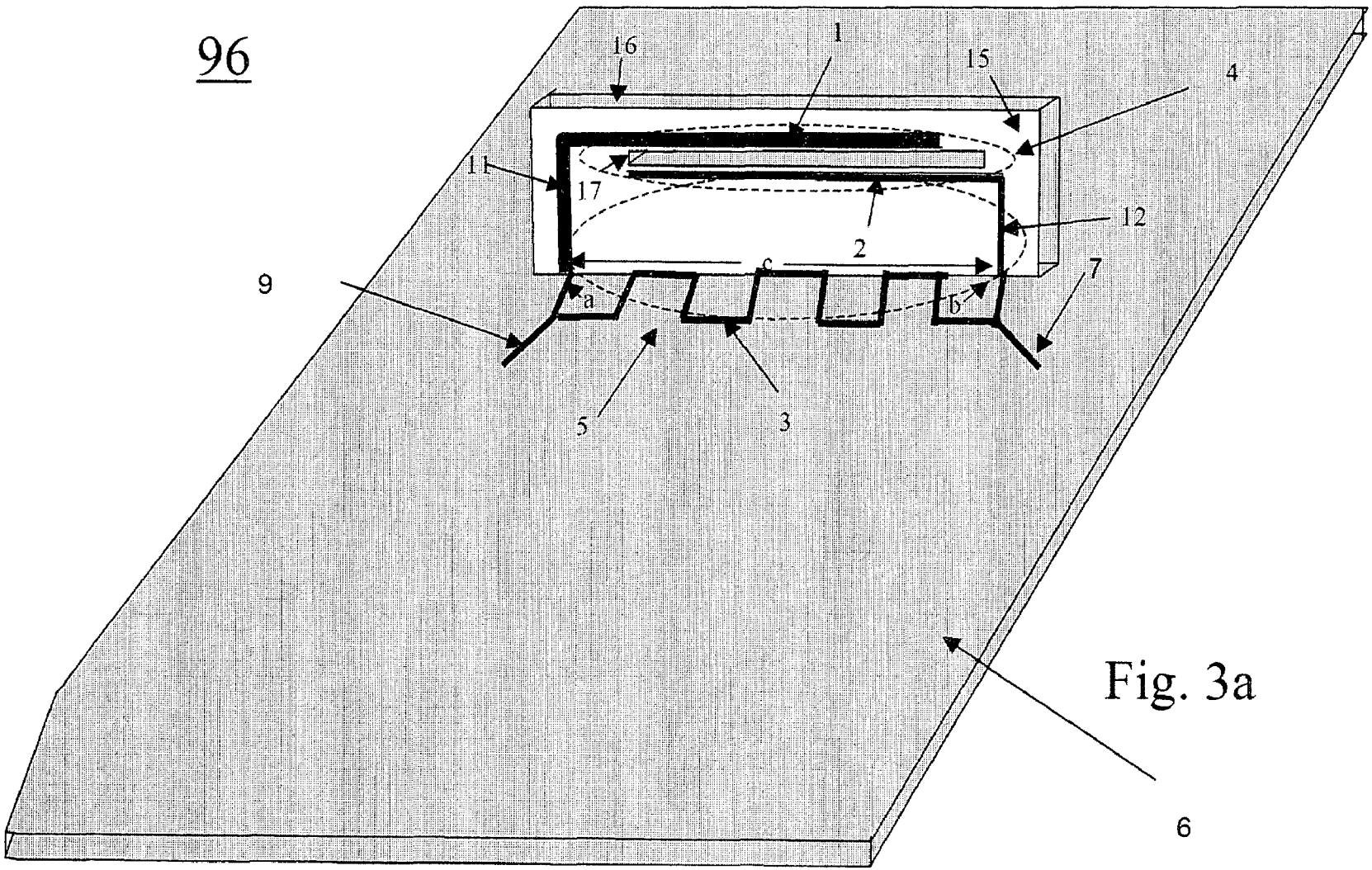
FIGS. 3*a-b* illustrate three dimensional views of a low profile/small form factor capacitively loaded dipole antenna.
Figure 3B:
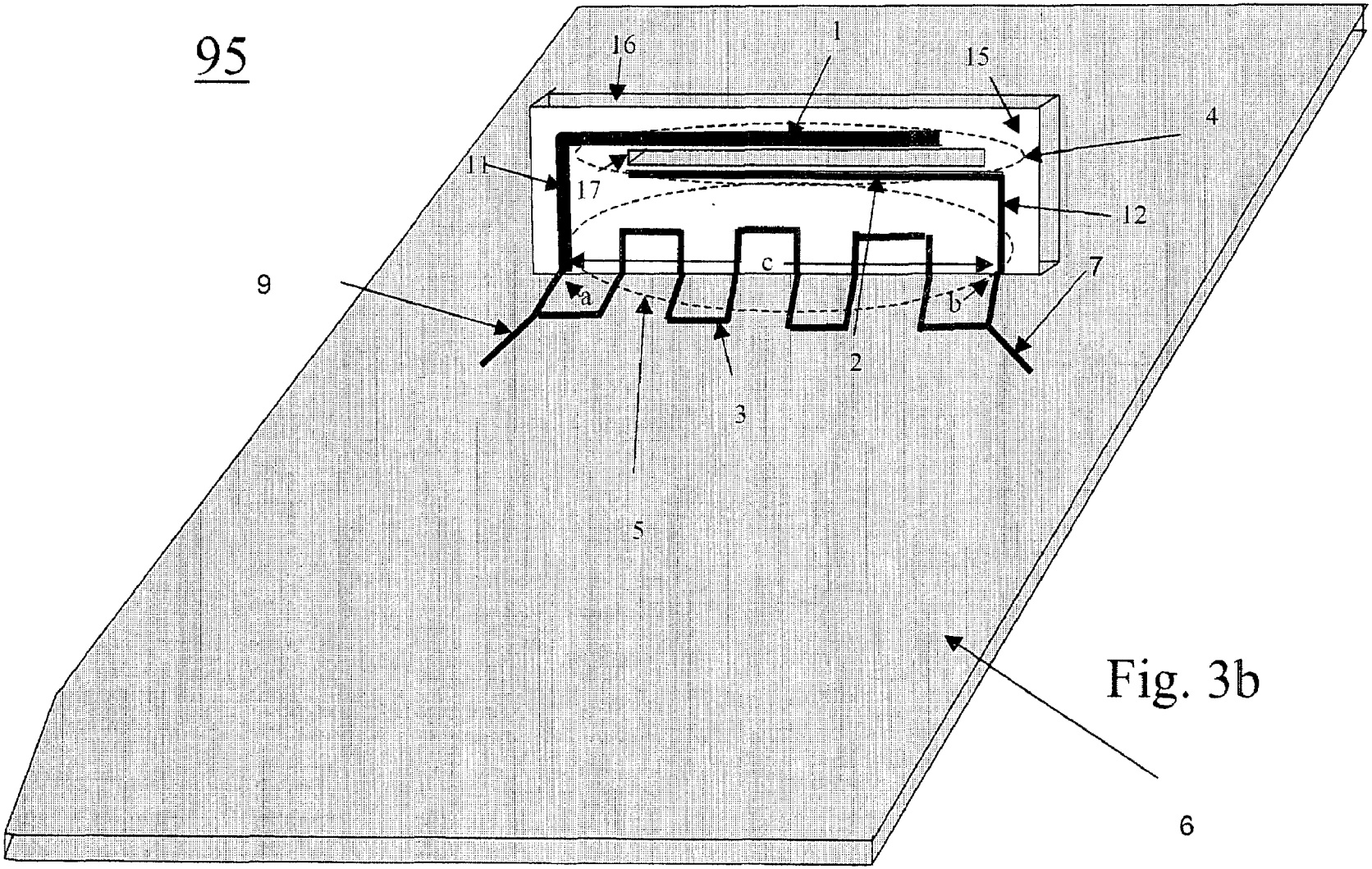

FIGS. 3*a-b* illustrate three-dimensional views of embodiments of a capacitively loaded magnetic dipole antenna (96) and (95). In one embodiment, the first portion (1) is coupled to the third portion (3) by a first coupling portion (11), and the third portion (3) is coupled to second portion (2) by a second coupling portion (12). In one embodiment, antenna (96) comprises a feedline (8) coupled to the third portion (3) where input or output signals are provided.

Some aspects of antenna (96) and (95) are similar to embodiments of antenna (99) described previously above and may be understood by those skilled in the art by referring to the description of antenna (99). However, it is identified that at least one aspect of antenna (96) and (95) differs from that of antenna (99). For example, in one embodiment, third portion (3) is defined by a length that is longer than a straight-line distance (c) between a first end (a) and a second end (b) of the third portion. FIGS. 3*a* and 3*b* also illustrate embodiments wherein at least one portion of the third portion (3) is disposed in a generally non-coplanar relationship relative to the generally coplanar relationship of the first portion (1) and second portion (2). FIG. 3*b* illustrates one embodiment where, additionally, at least one portion of the third portion (3) is disposed in a generally coplanar relationship relative to the generally coplanar relationship of the first portion (1) and second portion (2). It is identified that third portion (3) may include one or more portion that comprises or is coupled to comprise other geometries, for example, a linear geometry, a curved geometry, a combination thereof, etc.

FIGS. 3*a-b* also illustrate embodiments wherein at least one portion of third portion (3) may be disposed in a plane that is generally coplanar with, or above, a grounding plane (6). In one embodiment, third portion 93) is electrically isolated from the grounding plane (6) other than where third portion (3) is coupled to grounding plane (6) at a grounding point (7).

In one embodiment (not illustrated), the grounding plane (6) and/or at least a portion of third portion (3) may be disposed in a plane that is in an angular relationship relative to a coplanar relationship of first portion (1) and second portion (2). In one embodiment, the angular relationship relative to substrate (15) and may be between 0 and 180 degrees.

In one embodiment substrate (15) comprises a high dissipation factor substrate, for example, a FR4 substrate. In one embodiment, substrate (15) is defined by an outer periphery (16) and by an inner periphery (17), and the inner periphery defines a void within the substrate. In one embodiment, the capacitive area (4) generally spans the void.

It is identified that by coupling the first portion (1) and second portion (2) to a high dissipation factor substrate (15) such that the capacitive area spans the void (17), the capacitance of antennas (96) and (95) may be increased over that of the capacitance of antenna (99). As compared to a capacitance of antenna (99), an antenna (96) and (95) that has an equivalent capacitance may be provided to comprise a lower form-factor/profile.

It is also identified that by providing a third portion (3) that comprises a length that is longer than a straight line distance (c) between the first end (a) and the second end (b) of the third portion, the inductance of antenna (96) and (95) in the inductive area (5) may be increased over that of the inductance of antenna (99). As compared to an inductance of antenna (99), an antenna (96) and (95) that has an equivalent inductance may be provided to comprise a lower form-factor/profile.

Wireless communication systems and devices operating in one or more of frequency bands and utilizing one or more embodiments described herein are considered to be within the scope of the invention, for example, systems and devices such as PDA's, cell phones, etc.

Thus, it will be recognized that the preceding description embodies one or more invention that may be practiced in other specific forms without departing from the spirit and essential characteristics of the disclosure and that the invention is not to be limited by the foregoing illustrative details, but rather is to be defined by the appended claims.

What is claimed:

1. A dipole antenna comprising:

a first portion;

a second portion, the first and second portion disposed to create a capacitive area;

a third portion, the third portion comprising one or more portion, the third portion coupled to the first portion and to the second portion to create an inductive area, a substrate defined by a periphery, wherein within the periphery the substrate defines a void, wherein the capacitive area generally spans the void, and wherein the third portion comprises a length having a first end and a second end, and wherein the length is longer than a straight line distance between the first end and the second end.

2. The antenna of claim 1, wherein one or more portion of the third portion is disposed relative to the first portion and the second portion in a non-parallel relationship.

3. The antenna of claim 1 wherein one or more portion of the third portion is disposed relative to the first portion and the second portion in a parallel relationship.

4. The antenna of claim 1, wherein the first and second portion are disposed in a generally coplanar relationship, and wherein one or more portion of the third portion is disposed in a plane that is in an angular relationship relative to the coplanar relationship of the first and second portion.

5. The antenna of claim 1, wherein the first portion, the second portion, and the third portion are disposed on or above a ground plane.

6. The antenna of claim 5 wherein the substrate is coupled to the first portion and the second portion, and wherein the ground plane is disposed in an angular relationship relative to the substrate.

7. The antenna of claim 1, wherein the substrate comprises a high dissipation factor substrate.

8. The antenna of claim 1, wherein the substrate comprises a FR4 substrate.

9. The antenna of claim 1, wherein the first portion, the second portion, and the third portion are coupled to create a capacitively coupled dipole antenna.

10. A system, comprising:

a dipole antenna including, a first portion;

a second portion, the first and second portion disposed in a relationship to create a capacitive area;

a third portion, the third portion coupled to the first portion and to the second portion and disposed to create an inductive area, and a substrate coupled to the first and second portion, wherein the substrate is defined by a periphery, wherein within the periphery the substrate defines a void, wherein the capacitive area generally spans the void; and wherein the third portion comprises a length having a first end and a second end, and wherein the length is longer than a straight line distance between the first end and the second end.

11. The system of claim 10, wherein the substrate includes a high dissipation factor substrate.

12. The system of claim 10, wherein the substrate comprises a FR4 substrate.

13. The system of claim 10, wherein the system comprises a wireless communications device.

14. A capacitively coupled dipole antenna, comprising:

capacitance means for creating a capacitance;

inductive means for creating an inductance;

a first portion, a second portion, and a third portion, wherein the third portion comprises a length having a first end and a second end, and wherein the length is longer than a straight line distance between the first end and the second end; and a substrate, wherein the first and second portion are coupled to the substrate, wherein the substrate is defined by a periphery, wherein within the periphery the substrate defines a void, and wherein the capacitance generally spans the void.

15. A method for creating resonance in a resonant circuit, comprising the steps of:

providing a first portion;

providing a second portion;

disposing the first and second portion to create a capacitive area;

providing a third portion, wherein the third portion comprises a length having a first end and a second end, and wherein the length is longer than a straight line distance between the first end and the second end;

coupling the third portion to the first portion and to the second portion to create an inductive area; and providing a substrate defined by a periphery, wherein within the periphery the substrate defines a void, and wherein the capacitive area generally spans the void.

16. The method of claim 15, wherein the substrate is a high dissipation factor substrate.

17. The method of claim 15, wherein the substrate is an FR4 substrate.

* * * * *